US007128039B2

(12) United States Patent
Cooper

(10) Patent No.: US 7,128,039 B2
(45) Date of Patent: Oct. 31, 2006

(54) ENGINE AIR INDUCTION ARRANGEMENT AND METHOD

(75) Inventor: Richard A. Cooper, Bourne (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 10/731,923

(22) Filed: Dec. 10, 2003

(65) Prior Publication Data

US 2005/0126530 A1 Jun. 16, 2005

(51) Int. Cl.
*F02M 35/10* (2006.01)

(52) U.S. Cl. ..... 123/184.47; 123/184.32; 123/184.42

(58) Field of Classification Search ..... 123/184.21, 123/184.22, 52.1, 590, 184.32, 184.42, 184.47
See application file for complete search history.

(56) References Cited

U.S. PATENT DOCUMENTS 2,382,244 A * 8/1945 Lundquist et al. ..... 123/184.34
3,998,195 A * 12/1976 Scott ..... 123/590
4,765,286 A * 8/1988 Lyjak et al. ..... 123/184.55
5,076,218 A * 12/1991 Graziadei ..... 123/184.39
5,571,242 A * 11/1996 Demorest ..... 123/184.21
5,623,900 A * 4/1997 Topfer et al. ..... 123/184.42
6,427,671 B1 8/2002 Holz et al.

* cited by examiner

*Primary Examiner*—Noah P. Kamen
(74) *Attorney, Agent, or Firm*—W. Bryan McPherson; John J. Cheek

(57) ABSTRACT

Chaotic air flow structures in internal combustion engine manifolds may lead to poor combustion performance and hence undesirable emissions such as visible smoke. Manifolds with flow characteristics compromised by other design requirements are especially prone to these poor characteristics. To overcome these, an engine air induction arrangement includes a feed passage having an end portion in a manifold with cylinder ports. The end portion is formed in such a manner that air exiting the end portion via an opening is hindered from travelling away from the cylinder ports. This improves the flow structure and evens air distribution to the cylinder ports, hence improving the combustion process and reducing emission levels.

26 Claims, 4 Drawing Sheets

122c
122b
122a
125
120
136
3
3
118
124
131
128
130
130'
132
134
119
123
121
126

ENGINE AIR INDUCTION ARRANGEMENT AND METHOD

TECHNICAL FIELD

The present disclosure relates to improving airflow within a structure. In particular, but not exclusively, the disclosure relates to improving the airflow in a manifold of an internal combustion engine.

BACKGROUND

Incomplete combustion in internal combustion engines may cause visible smoke exiting the exhaust system. This may contravene emission regulations and may also be perceived as negative by users and other members of the public with regards to health and environment issues.

A multi-cylinder internal combustion engine can produce excessive smoke during low engine speeds if the air feed passage terminates at the manifold. Combustion airflow fed into the manifold from a feed passage can have an unstructured characteristic and can become chaotic once in the manifold. The chaotic airflow motion in the manifold continues into the inlet port to the combustion chamber and causes the in-cylinder swirl motion to become unstable resulting in incomplete combustion. Smoke issues are limited at higher speeds due to the airflow structure changing with the airflow speed. One solution is to adapt the port shape design, but this will result in high development costs and may have a negative impact on the performance at higher engine speeds where emission levels are critical. Further challenges may arise due to restrictions to the design of the manifold itself, as the availability of multiple customer options may depend on particular manifold configurations. The present disclosure is directed at overcoming one or more of the above identified problems.

SUMMARY OF THE INVENTION

According to one aspect of the present disclosure there is provided an air induction arrangement for an internal combustion engine with an inlet manifold having a first cylinder port and at least a second cylinder port. It further has a feed passage having an opening within the inlet manifold, the opening having a periphery. A first portion of the periphery is distal to the first of the cylinder ports, a second portion of the periphery is proximal to the first of the cylinder ports. The first portion protrudes further into the inlet manifold than the second portion.

According to another aspect of the disclosure there is provided an air induction arrangement for an internal combustion engine, comprising an inlet manifold having a plurality of cylinder ports and a feed passage having an opening within the inlet manifold. The opening is formed such as to hinder air departing from the opening from travelling away from the cylinder ports.

A further aspect of the disclosure provides an air induction arrangement for an internal combustion engine, comprising an inlet manifold having a plurality of cylinder ports and a feed passage having an end within the inlet manifold. The end includes means for hindering air departing from the feed passage from travelling away from the cylinder ports.

Yet another aspect of the disclosure provides a method of operating an internal combustion engine comprising supplying air to a combustion site, supplying fuel to a combustion site and combusting the fuel and air. The particle emissions from the combustion step is reduced by supplying air to the combustion site via an air induction arrangement as disclosed.

Other features and aspects of this disclosure will be apparent from the following description and the accompanying drawings.

DETAILED DESCRIPTION

Figure 1:
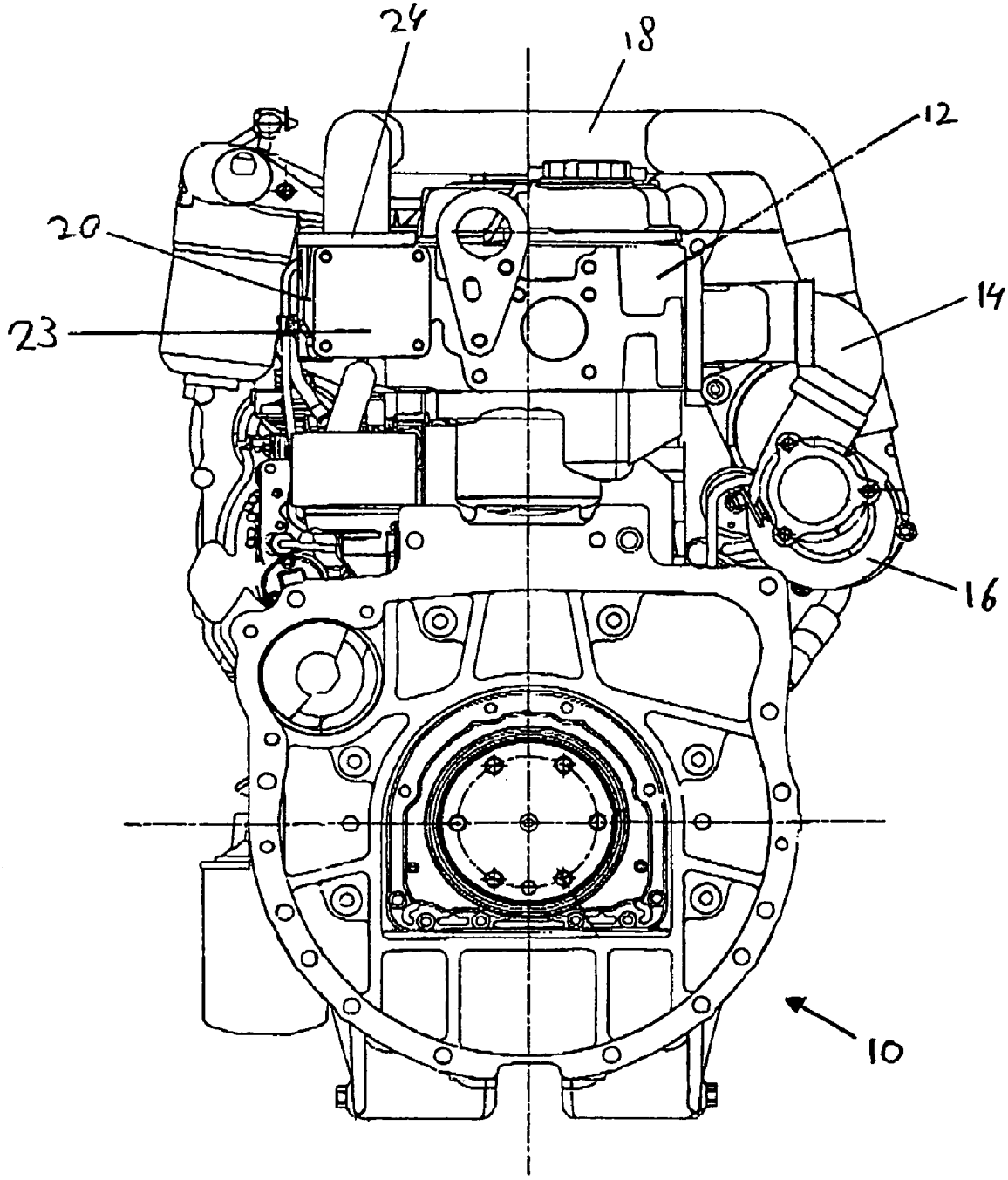
FIG. 1 is a schematic frontal view of an internal combustion engine showing feed passage and intake manifold.

With reference to FIG. 1, internal combustion engine 10 is shown as a turbocharged engine, but the principle of this disclosure may also be applied to engines with other induction arrangements such as supercharged engines or naturally aspirated engines.

Exhaust gas produced by the combustion process in internal combustion engine 10 flows from cylinder head 12 through passage 14 to turbocharger 16. Turbocharger 16 draws in induction air via an air filter (not shown) and forces the air through a feed passage 18 into manifold 20. Feed passage 18 is connected via flange 24 to the top side of manifold 20, but a different arrangement may be achieved by removing manifold cover plate 23. Removing manifold cover plate 23 reveals an alternative mounting position for a feed passage similar to feed passage 18, but adapted to correspond to this alternative position. The ability to vary the position of the connection between the feed passage and the manifold enables a set of different engine envelopes to suit different installation environments.

Figure 2:
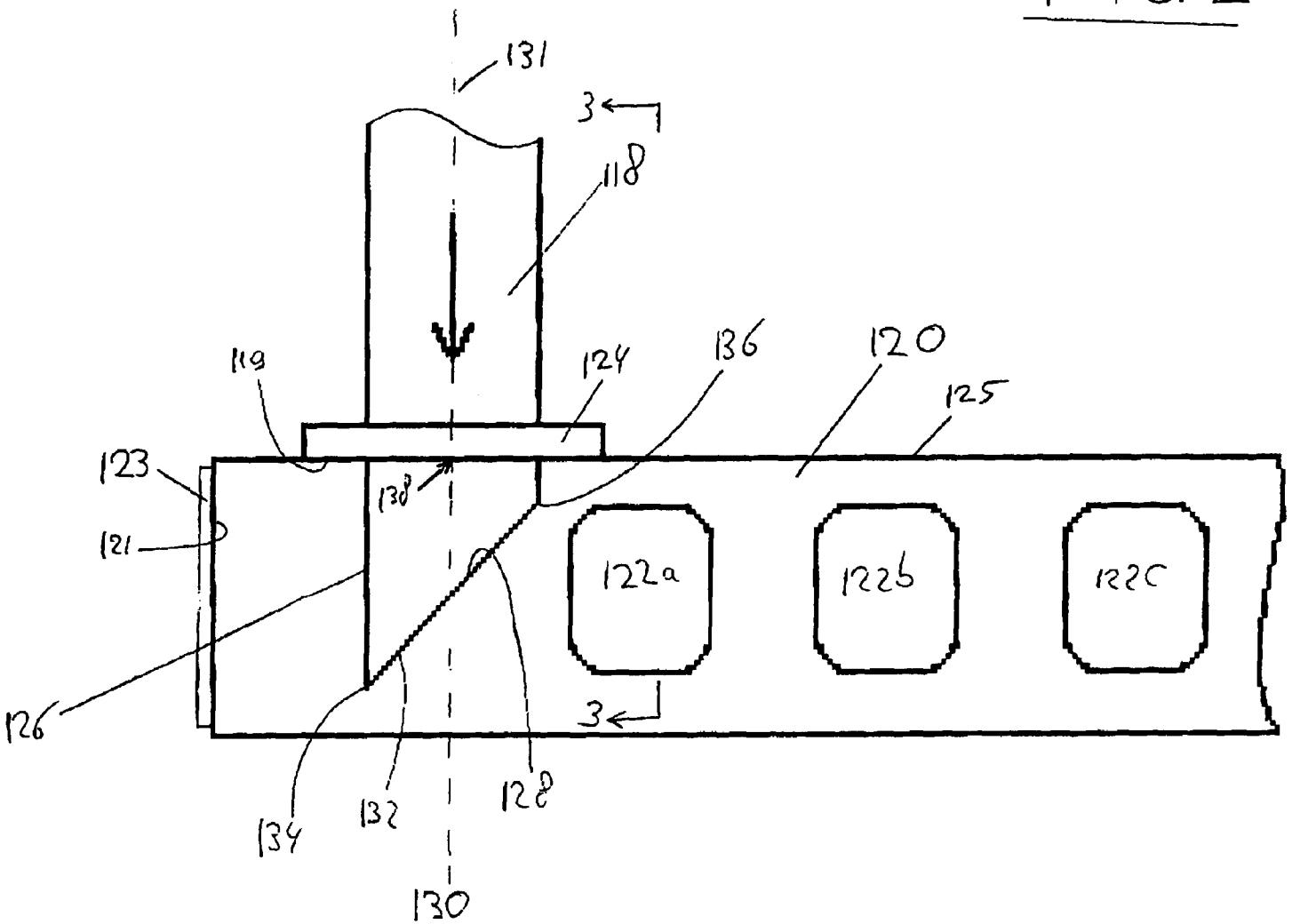
FIG. 2 is a fragmentary schematic representation of a first embodiment of an engine air induction arrangement according to the present disclosure.

FIG. 2 shows a first embodiment of the present invention. Manifold 120 is shown as having cylinder ports 122*a*, 122*b* and 122*c*, but the principle is applicable to manifolds with any number of cylinder ports. Manifold 120 may have a plurality of openings adapted to receive a feed passage such as feed passage 118. In FIG. 2 a possible arrangement is shown having two openings. However, more openings could be present to offer a larger degree of flexibility in installation options. The arrangement shown has feed passage 118 connected to manifold 120 via opening 119 in surface 125 of manifold 120. Feed passage 118 is connected via flange 124 to the top side of manifold 120, but a different arrangement may be achieved by removing manifold cover plate 123 to reveal opening 121.

Air is fed into manifold 120 via feed passage 118. Feed passage 118 has an end portion 126 within manifold 120. End portion 126 has a longitudinal axis 130 which in this example coincides with longitudinal axis 131 of a part of feed passage 118 that is external of manifold 120. Axes 130 and 131 are shown as being perpendicular to surface 125, but perpendicularity is not essential therefore axes 130 and 131 may intersect surface 125 at other angles.

End portion 126 further has an opening 128 with periphery 132 through which the air flows into manifold 120. In this example, all portions of periphery 132 lie in a same plane, but periphery 132 may be formed of portions lying in different planes or following different curvatures.

Figure 3:
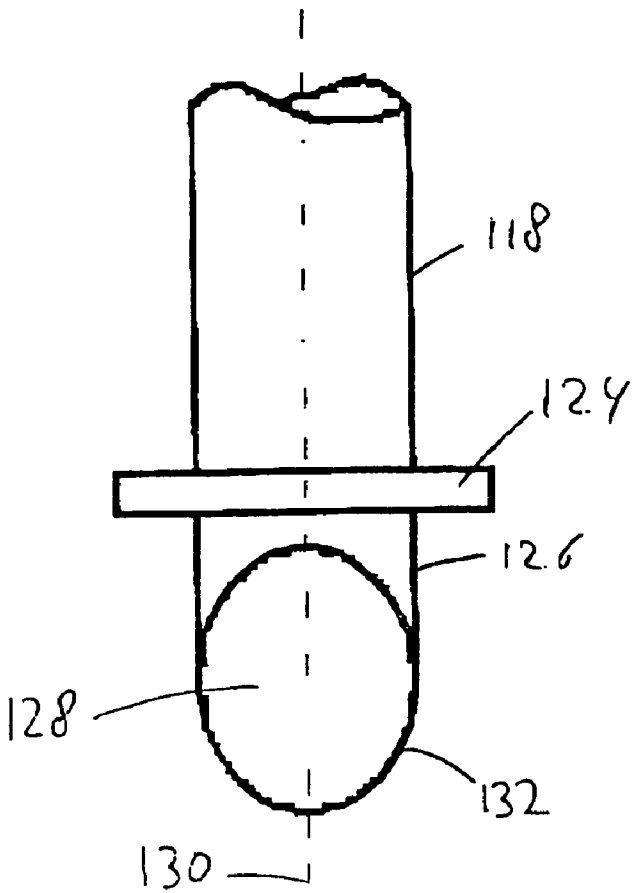
FIG. 3 is a schematic representation of a possible detail of the first embodiment looking in the direction of arrows 3—3 in FIG. 2.

Periphery 132 has a first portion 134 and a second portion 136, portion 134 being distal and portion 136 being proximal to cylinder ports 122. Reference point 138 is the intersection of axis 130 and a point lying in the same plane as surface 125. As seen from reference point 138, portion 134 protrudes further into manifold 120 than portion 136. This has the effect that any air exiting opening 128 is hindered from travelling away from cylinder ports 122 and is at least partially prevented from forming chaotic air flows having directions other than generally towards cylinder ports 122. Therefore most air will follow concurrent flow paths, resulting in a substantially even distribution to cylinder ports 122. If end portion 126 is a cylindrical member cut at an angle across longitudinal axis 130, periphery 132 will have a substantially elliptical shape as shown in FIG. 3.

Figure 4:
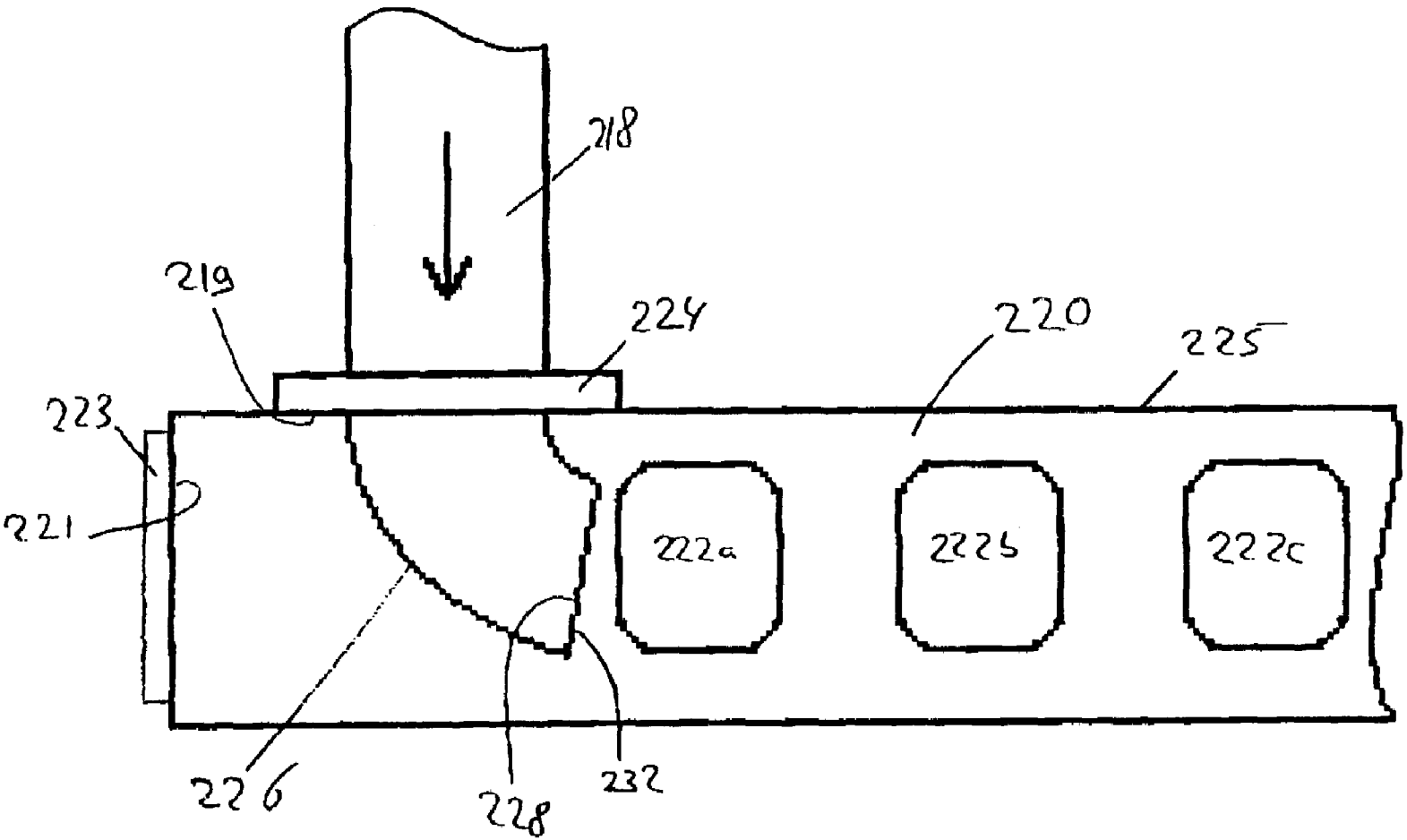
FIG. 4 is a fragmentary schematic representation of a second embodiment of an engine air induction arrangement according to the present disclosure.

FIG. 4 shows a second embodiment of the present disclosure. Manifold 220 is shown as having cylinder ports 222*a*, 222*b* and 222*c*, but the principle is applicable to manifolds with any number of cylinder ports. Manifold 220 further has a plurality of openings adapted to receive a feed passage such as feed passage 218. In FIG. 4 a possible arrangement is given as example showing two openings. However, more openings could be present to offer a larger degree of flexibility in installation options. The arrangement shown has feed passage 218 connected to manifold 220 via opening 219 in surface 225 of manifold 220. Feed passage 218 is connected via flange 224 to the top side of manifold 220, but a different arrangement may be achieved by removing manifold cover plate 223 to reveal opening 221.

Air is fed into manifold 220 via feed passage 218. Feed passage 218 has an end portion 226 within manifold 220. End portion 226 has an opening 228 with periphery 232 through which the air flows into manifold 220. In this example, all portions of periphery 232 lie in a same plane, but periphery 232 may be formed of portions lying in different planes or following different curvatures. End portion 226 comprises a substantially elbow shaped portion. The elbow is shown as extending less than 90 degrees, however the angle of the elbow can be different if preferred. This has the effect that any air exiting opening 228 is hindered from travelling away from cylinder ports 222 and is at least partially prevented from forming chaotic air flows having directions other than towards cylinder ports 222. Therefore most air will follow concurrent flow paths, resulting in a substantially even distribution to cylinder ports 222. Alternatively the elbow shaped portion may be replaced by two or more portions of tube connected together in such a way that their longitudinal axes do not coincide or run parallel to each other.

INDUSTRIAL APPLICABILITY

This disclosure provides a solution for overcoming a chaotic air flow structure in an engine manifold. Conflicting practical requirements for manifolds may lead to compromises in the design. For example, the manifold may have to be designed in such a way that multiple entry points for a feed passage are available. However, this may result in less than optimal flow characteristics within the manifold due to the shape of the manifold. To improve these flow characteristics, the disclosure reveals a feed pipe design that hinders air from travelling in undesired directions in a manifold and hence improves airflow structures.

To achieve this, the illustrated embodiments of the present disclosure shows feed pipe 118 having an end section 126, 226 located within manifold 120, 220. End section 126, 226 is formed in such a way that it hinders air exiting end section 126, 226 through opening 128, 228 in a direction away from cylinder ports 122, 222, creating a much improved airflow structure in the manifold, encouraging a substantially even air distribution to cylinder ports 122, 222. This has a direct and positive impact on the combustion process, as the structured air flow and even air distribution improve the in-cylinder swirl, which is critical for achieving optimum combustion. In use, combustion air is supplied to a combustion chamber or other combustion site (not shown) via an engine air induction system as described above. Fuel is also supplied to the combustion site via suitable, well known mechanisms such as fuel injectors for example. The fuel and air are combusted, for example by compression ignition or spark ignition. Particle emissions are reduced compared to prior designs by supplying the combustion air to the combustion site via an engine air induction system as described above. These reduced emissions can be achieved especially at relatively low engine speeds. Although the various embodiments are described above, those skilled in the art will appreciate that modifications may be made without departing from the scope of the following claims.

What is claimed is:

1. An air induction arrangement for an internal combustion engine, comprising;

an inlet manifold having a first cylinder port and at least a second cylinder port;

a feed passage having an opening within said inlet manifold, said opening having a periphery;

wherein a first portion of said periphery is distal to the first of said cylinder ports, a second portion of said periphery is proximal to the first of said cylinder ports, and said first portion protrudes further into said inlet manifold than said second portion.

2. An air induction arrangement according to claim 1, wherein said feed passage is a tubular member having an end portion with a longitudinal axis and an end surface lying in a plane transverse but not perpendicular to said longitudinal axis of said end portion.

3. An air induction arrangement according to claim 1, wherein the end of the feed passage comprises a tubular member cut at an angle across a longitudinal axis thereof.

4. An air induction arrangement according to claim 1, wherein said periphery, has a substantially elliptical shape.

5. An air induction arrangement according to claim 1, wherein said feed passage comprises an elbow positioned at least partially within said manifold.

6. An air induction arrangement according to claim 5, wherein said elbow extends less than 90 degrees.

7. An air induction arrangement according to claim 1, wherein said feed passage has a flange for connecting said feed passage to said inlet manifold.

8. An air induction arrangement according to claim 1 wherein said feed passage is partially located outside said inlet manifold.

9. An air induction arrangement according to claim 1 wherein said feed passage is partially located outside said inlet manifold.

10. A method of operating an internal combustion engine, comprising:

supplying air to a combustion site;

supplying fuel to a combustion site;

combusting said fuel and air; and reducing particle emissions from said combustion step by supplying air to the combustion site via an air induction arrangement according to claim 1.

11. An air induction arrangement for an internal combustion engine, comprising:

an inlet manifold having a plurality of cylinder ports;

a feed passage having an opening within said inlet manifold, said feed passage including a tubular member having an end portion with a longitudinal axis and an end surface lying in a plane transverse but not perpendicular to said longitudinal axis of said end portion.

12. An air induction arrangement according to claim 11, wherein said opening is formed such as to hinder air departing from said opening from traveling away from a majority of said cylinder ports.

13. An air induction arrangement according to claim 11, wherein said tubular member is cut at an angle across a longitudinal axis thereof.

14. An air induction arrangement according to claim 11, wherein said feed passage has a flange for connecting said feed passage to said inlet manifold.

15. An air induction arrangement according to claim 11, wherein said opening is formed such as to hinder air departing from said opening from traveling away from all of said cylinder ports.

16. A method of operating an internal combustion engine, comprising:

supplying air to a combustion site;

supplying fuel to a combustion site;

combusting said fuel and air; and reducing particle emissions from said combustion step by supplying air to the combustion site via an air induction arrangement according to claim 11.

17. An air induction arrangement for an internal combustion engine comprising: an inlet manifold having a plurality of cylinder ports; a feed passage having an elbow positioned at least partially within said manifold and an opening within said inlet manifold, said opening being formed such as to hinder air departing from said opening from traveling away from a majority of said cylinder ports.

18. An air induction arrangement according to claim 17, wherein said elbow extends less than 90 degrees.

19. An air induction arrangement according to claim 17 wherein said elbow is positioned within said manifold.

20. An air induction arrangement for an internal combustion engine, comprising:

an inlet manifold having a plurality of cylinder ports;

a feed passage including a tubular member with an end portion within said inlet manifold, said tubular member having a longitudinal axis and an end surface lying in a plane transverse but not perpendicular to said longitudinal axis of said end portion for hindering air departing from said feed passage from traveling away from a majority of said cylinder ports.

21. An air induction arrangement according to claim 20, wherein the end of the feed passage comprises a tubular member cut at an angle across a longitudinal axis thereof.

22. A method of operating an internal combustion engine, comprising:

supplying air to a combustion site;

supplying fuel to a combustion site;

combusting said fuel and air; and reducing particle emissions from said combustion step by supplying air to the combustion site via an air induction arrangement according to claim 20.

23. An air induction arrangement for an internal combustion engine, comprising:

an inlet manifold having a plurality of cylinder ports;

a feed passage including an elbow positioned at least partially within said manifold, said feed passage having an end within said inlet manifold, said end including means for hindering air departing from said feed passage from traveling away from a majority of said cylinder ports.

24. An air induction arrangement for an internal combustion engine, comprising;

an inlet manifold defining an interior space, said inlet manifold having a first port adapted to deliver air from the interior space to a first engine combustion chamber and at least a second port adapted to deliver air from the interior space to a second engine combustion chamber;

a feed passage for feeding air into the inlet manifold interior space, said feed passage having an end portion with a longitudinal axis and an end surface lying in a plane transverse but not perpendicular to said longitudinal axis of said end portion, said feed passage further having an opening located within said inlet manifold space, said opening having a periphery and a configuration;

wherein the configuration of said feed passage opening is at least one of (a) a configuration such as to hinder air departing from said opening from traveling away from a majority of the manifold ports, (b) a configuration such that a first portion of said periphery is distal to one of said manifold ports, a second portion of said periphery is proximal to said one of said manifold ports, and said first portion protrudes further into said inlet manifold interior space than said second portion, and (c) a configuration including means for supplying air to the combustion chambers in a manner to reduce particle emissions from air-fuel combustion in the combustion chambers.

25. An air induction arrangement according to claim 24 wherein said feed passage is partially located outside said inlet manifold.

26. An air induction arrangement according to claim 24, wherein configuration a) is a configuration such as to hinder air departing from said opening from traveling away from all of said cylinder ports.

* * * * *